US011795640B2

(12) United States Patent
Neusch

(10) Patent No.: US 11,795,640 B2
(45) Date of Patent: Oct. 24, 2023

(54) VEHICLE BARRIER

(71) Applicant: Neusch Innovations, LP, Marble Falls, TX (US)

(72) Inventor: William H. Neusch, Marble Falls, TX (US)

( * ) Notice: Subject to any disclaimer, the term of this patent is extended or adjusted under 35 U.S.C. 154(b) by 0 days.

(21) Appl. No.: 17/516,665

(22) Filed: Nov. 1, 2021

(65) Prior Publication Data

US 2022/0056653 A1 Feb. 24, 2022

Related U.S. Application Data

(63) Continuation of application No. 16/167,260, filed on Oct. 22, 2018, now Pat. No. 11,162,234, which is a continuation of application No. 15/135,400, filed on Apr. 21, 2016, now Pat. No. 10,106,939.

(60) Provisional application No. 62/165,163, filed on May 21, 2015, provisional application No. 62/151,370, filed on Apr. 22, 2015.

(51) Int. Cl.
*E01F 15/00* (2006.01)
*E01F 13/12* (2006.01)

(52) U.S. Cl.
CPC ..... *E01F 13/12* (2013.01); *E01F 15/00* (2013.01)

(58) Field of Classification Search
None
See application file for complete search history.

(56) References Cited

U.S. PATENT DOCUMENTS 1,913,715 A * 6/1933 MacDonald ..... E01F 15/06 256/13.1
2,101,176 A * 12/1937 Height ..... E01F 15/0415 256/13.1
3,332,666 A * 7/1967 Gray ..... E01F 15/0415 52/297
3,390,865 A * 7/1968 Jehu ..... E01F 15/0461 256/13.1
3,417,965 A * 12/1968 Gray ..... E01F 15/0415 256/13.1
5,044,609 A * 9/1991 Cicinnati ..... E01F 15/0415 256/19
5,657,966 A * 8/1997 Cicinnati ..... E01F 15/0438 404/6
7,249,909 B2 * 7/2007 Bibber ..... E01F 13/12 404/6
2019/0010727 A1 * 1/2019 Messelis ..... E04H 17/08

* cited by examiner

*Primary Examiner* — Thomas B Will
*Assistant Examiner* — Katherine J Chu
(74) *Attorney, Agent, or Firm* — Bradley Arant Boult Cummings LLP; Henry L. Ehrlich

(57) ABSTRACT

A vehicle barrier includes a longitudinally extending beam positioned vertically above a ground level and separating a protected side from an attack side, the beam comprising beam sections, each of the beam sections comprising a web oriented generally parallel to the ground level, a line post positioned on the attack side and comprising a bottom end positioned in a concrete foundation and a frame, a line brace having a first brace end located with the frame and a second end secured in the concrete foundation such that the line brace and the concrete foundation form adjacent sides of a vertex on the protected side, and adjacent beam sections pivotally connected to each other at the frame and the first brace end.

20 Claims, 13 Drawing Sheets

VEHICLE BARRIER

BACKGROUND

This section provides background information to facilitate a better understanding of the various aspects of the disclosure. It should be understood that the statements in this section of this document are to be read in this light, and not as admissions of prior art.

Anti-ram vehicle barrier systems are used to guard against access to protected areas. In particular, the systems are provided to stop motor vehicles, such as trucks, from being intentionally driven into certain areas for nefarious purposes. At least one agency of the United States Government has provided standards to certify barriers for use.

SUMMARY

An exemplary vehicle barrier includes a longitudinally extending beam positioned vertically above a ground level and separating a protected side from an attack side, the beam comprising beam sections, each of the beam sections comprising a web oriented generally parallel to the ground level, a line post positioned on the attack side and comprising a bottom end positioned in a concrete foundation and a frame, a line brace having a first brace end located with the frame and a second end secured in the concrete foundation such that the line brace and the concrete foundation form adjacent sides of a vertex on the protected side, and adjacent beam sections pivotally connected to each other at the frame and the first brace end.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
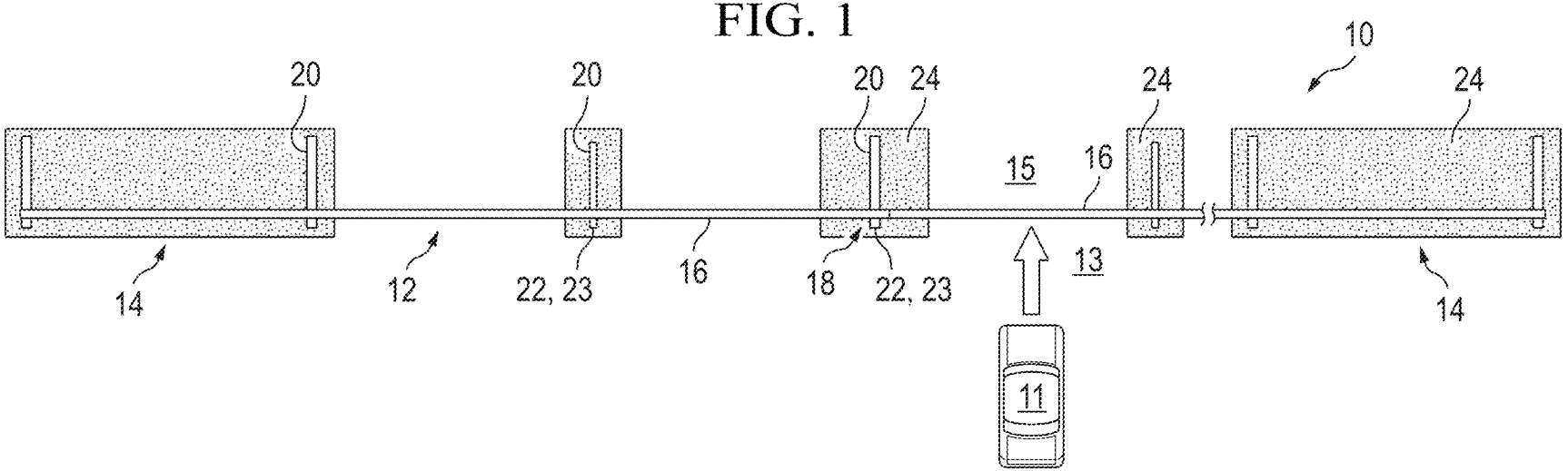
FIG. 1 is a plan view of a section of an exemplary anti-ram passive vehicle barrier according to aspects of the disclosure.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

Figure 2:
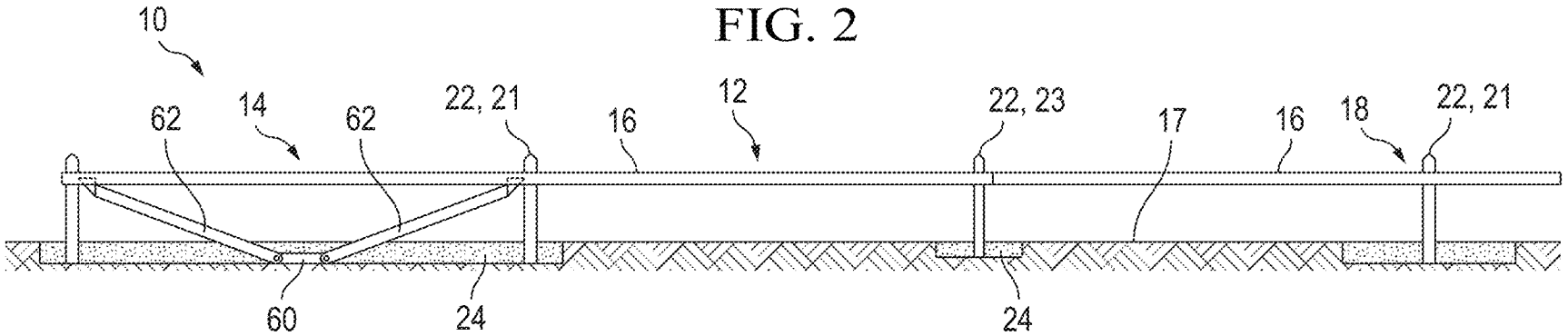
FIG. 2 is an elevation view of a portion of the exemplary anti-ram passive vehicle barrier of FIG. 1.
Figure 3:
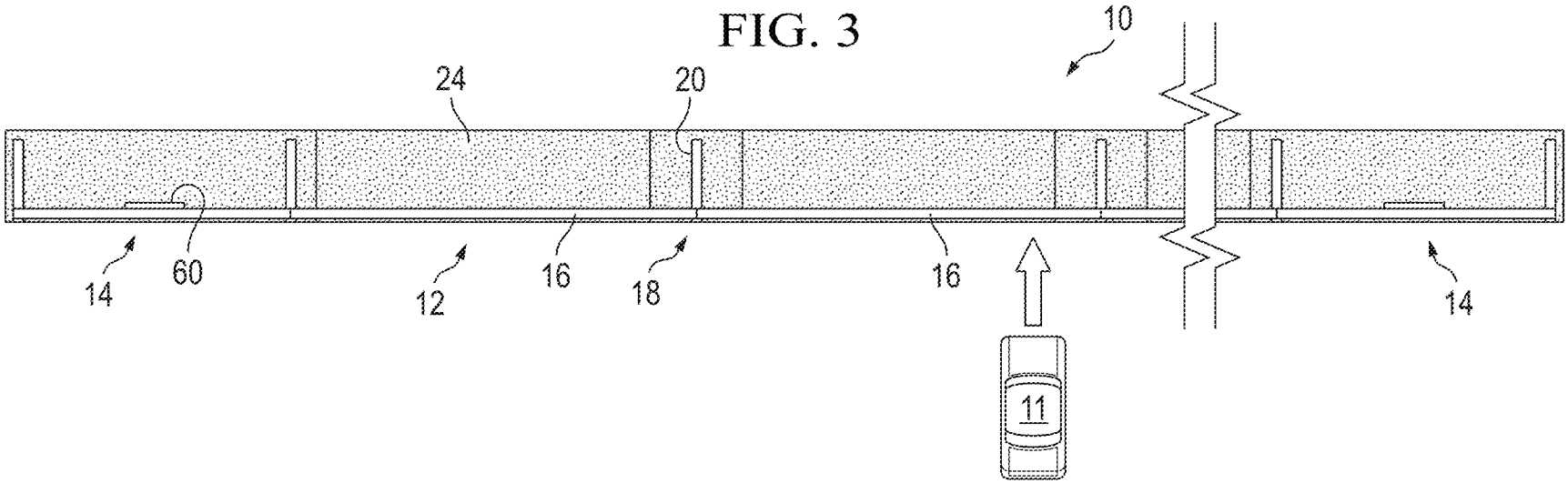
FIG. 3 is a plan view of a section of an exemplary anti-ram passive vehicle barrier according to aspects of the disclosure.
Figure 4:
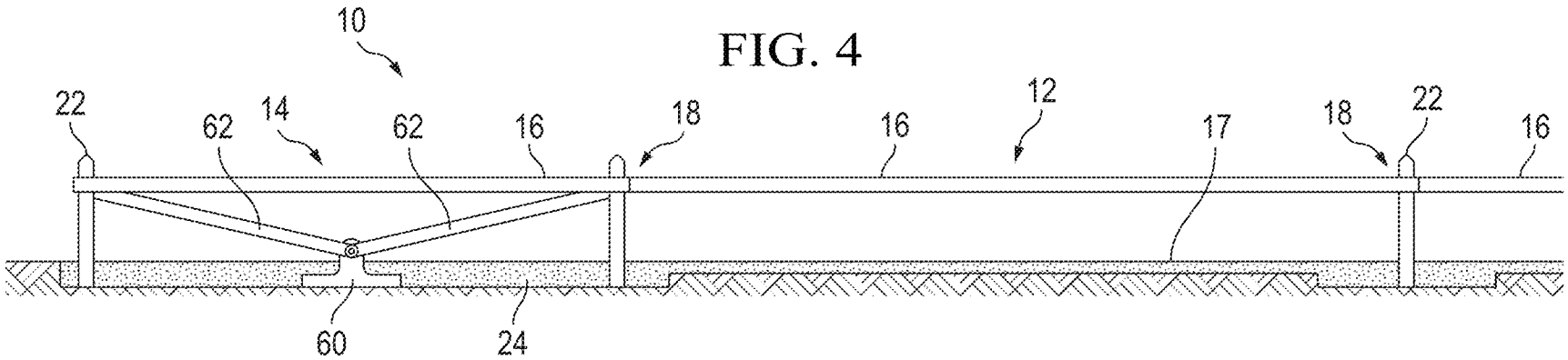
FIG. 4 is an elevation view of a portion of the exemplary anti-ram passive vehicle barrier of FIG. 3.

FIGS. 1 and 3 are plan views of examples of sections of a passive vehicle barrier (PVB), generally denoted by the numeral 10, according to aspects of this disclosure. FIGS. 2 and 4 are elevation views from an attack side of the PVBs illustrated respectively in FIGS. 1 and 3.

PVB 10 is configured to stop the penetration of a motor vehicle that crashes into the barrier. PVB 10 should fully stop any impacting vehicle within a desired penetration distance, for example, to keep explosives carried by the vehicle at a selected standoff distance from facilities located within the barrier perimeter. United States federal agencies (e.g., the U.S. Department of Defense (DOD) and the Department of State (DOS)) have developed test standards using crash tests to quantify, verify, and certify barrier performance. Such test methods were initially published by the U.S. Dept. of State in 1985 as SD-STD-02.01, which was revised in 2003 as SD-STD-02.01 Revision A, and which was replaced in 2009 with ASTM F2656 (Standard Test Method for Vehicle Crash Testing of Perimeter Barriers). Embodiments of PVB 10 are configured to be crash-rated by certifying agencies such as DOD, DOS, ASTM, and British Standards (BSI). Vehicle barriers are tested by crashing a motor vehicle from a perpendicular direction into the barrier. The vehicle barrier is rated based on the test vehicles weight, the speed of impact, and the penetration of the vehicle (e.g., the cargo bed) beyond the pre-impact inside edge of the barrier. For example, a "K" or "M" designates a medium duty vehicle with a gross weight of 15,000 pounds (6810 kg). The speed ratings include K4/M30 for traveling at 28.0 to 37.9 miles per hour (mph), K8/M40 traveling at 38.0 to 46.9 mph, and K12/M50 traveling at 47.0 mph and above. The penetration ratings include P1 for less than or equal to 1 meter (3.3 ft.), P2 for 1.10 to 7 m (3.31 to 23.0 ft.), and P3 for 7.01 to 30 m (23.1 to 98.4 ft.). For example, an M50 P1 crash barrier is designed to stop a medium duty truck traveling 50 mph with a penetration distance of 3.3 feet or less.

In FIGS. 1 and 3, PVB 10 is positioned between a protected side 15 and a motor vehicle 11 approaching PVB 10 from an attack side 13. For example, beam 12 may be supported approximately three feet off of ground level 17. According to aspects of the disclosure, PVB 10 is configured to achieve a crash rating. In some embodiments, PVB 10 is configured to achieve a crash rating of M50 P1. In some embodiments, PVB 10 is configured to achieve a crash rating based upon a motor vehicle 11 impacting the barrier in a span of the beam between adjacent line posts or adjacent braces.

PVB 10 includes a continuous beam 12 positioned above ground level 17. PVB 10 may include one or more truss sections 14. In the illustrated examples, truss sections 14 are illustrated at terminal ends of a longitudinal length of continuous beam 12, however, truss sections 14 may be positioned within a longitudinal span of continuous beam 12. Beam 12 is formed of interconnected beam sections 16. Adjacent beams sections 16 are connected at joints 18. Joints 18 are pivoting connections that permit a degree of pivoting movement between adjacent beam sections 16 or a beam section and a post when beam 12 is impacted by a motor vehicle. Examples of pivot connections at joints 18 are illustrated in FIGS. 6A-6C, 7, and 10-15.

Posts, generally denoted by the numeral 22, are connected to beam 12, for example, to support beam 12 above ground level and to provide tension to mitigate lift of beam 12 in response to the impact of the motor vehicle. Posts 22 are metal members and may take various forms including I-beams, round or rectangular (e.g., square) members. Posts 22 may be arranged in a line post configuration, identified specifically with reference number 21, connected to beam 12 at a joint 18. Posts 22 may be arranged in an intermediate configuration, identified specifically with reference number 23, connected to beam 12 at an intermediate position in between joints 18. Some or all of posts 22 may be used to support an ornamental fence structure, e.g., a chain link section.

Figure 5A:
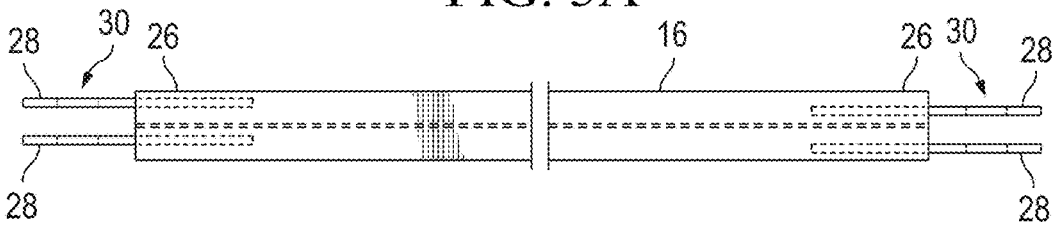
FIGS. 5A and 5B are views of an exemplary beam section.
Figure 5B:
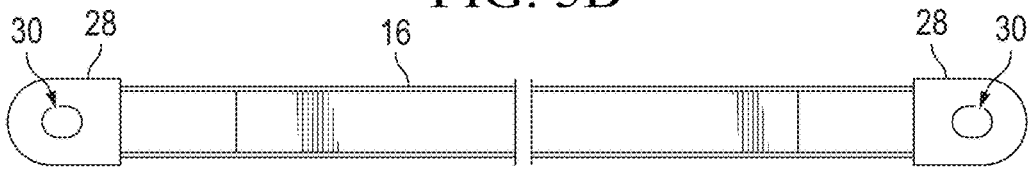

FIGS. 5A and 5B illustrate an exemplary beam section 16. Beam section 16 is a metal member, for example, an I-beam, for example, a wide flange beam or W-beam, extending between opposing terminal ends 26. Beam section 16 may be provided in different lengths. For example, in FIGS. 1 and 2, beam sections 16 may be forty feet and in FIGS. 3 and 4 beam sections 16 may be for example twenty or thirty feet in length. The dimensions described are non-limiting examples. A beam plate 28, e.g., connector, having a central aperture or hole 30 is attached at each terminal end 26. Two beam plates 28 are spaced apart vertically and attached at each terminal end 26 with the respective holes 30 coaxially aligned to dispose a pin and pivotally connect adjacent beam section and/or pivotally attached a beam section to a post.

Figure 5C:
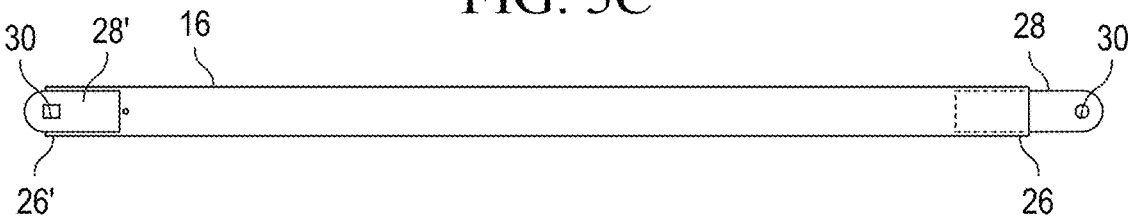
FIGS. 5C and 5D are views of an exemplary beam section.
Figure 5D:
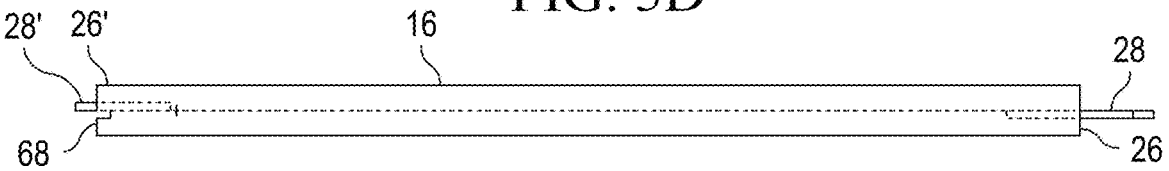

FIGS. 5C and 5D illustrate another exemplary beam section 16. In this example, beam section 16 is referred to a female-male beam section 16. Female-male beam section 16 has a female terminal end 26' on the left side carrying a female beam plate 28'. Exemplary female terminal end 26' has and a groove or slot 68 to receive a beam plate 28 of an adjacent beam section 16 or to receive an independent connector plate, see, e.g., FIGS. 5E-5H. The second terminal end 26 of the female-male beam section is a male end carrying a beam plate 28. In this example, male beam plate 28 extends a greater distance away from terminal end 26 than female beam plate 28' extends from terminal end 26'. In the illustrated example, female beam plate 28' has a square hole 30 as opposed to a circular hole 30 formed in the male beam plate 28. In some embodiments, beam section 16 may be a female-female section having female beam plate(s) 28' at both terminal ends or a male-male beam section illustrated for example in FIGS. 5A and 5B.

Figure 5E:
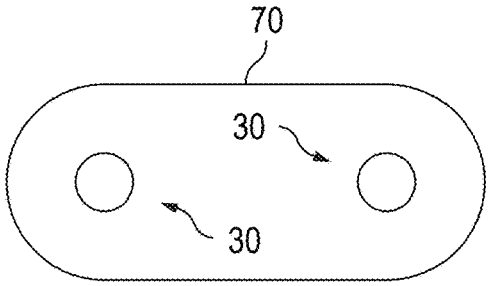
FIGS. 5E-5H illustrate exemplary connector plates to pivotally connect a beam section to a post and/or to an adjacent beam section.
Figure 5G:
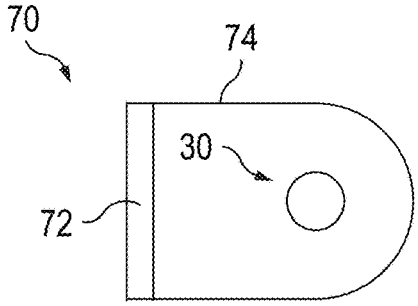
Figure 5F:
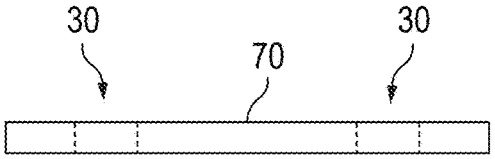
Figure 6A:
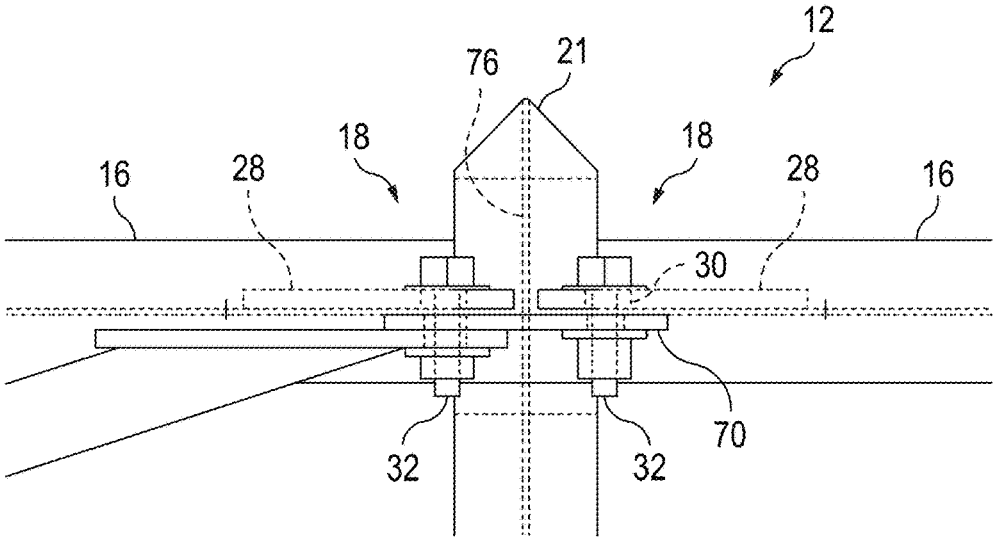
FIG. 6A illustrates an example of a pivotal connection of adjacent beam sections at a post.

FIGS. 5E and 5F illustrate an exemplary independent connector plate 70 configured for pivotally connecting adjacent beam sections for example at a post such as illustrated in FIG. 6A. In this example, connector 70 is a generally metal planar member having two holes 30 spaced apart and located on opposite sides of the planar connector plate 70.

Figure 5H:
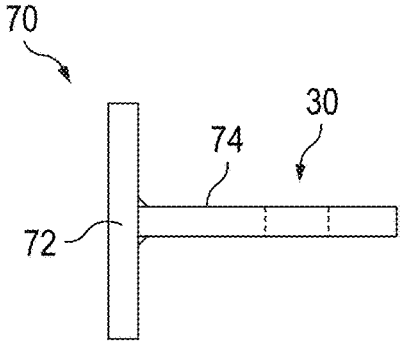
Figure 6B:
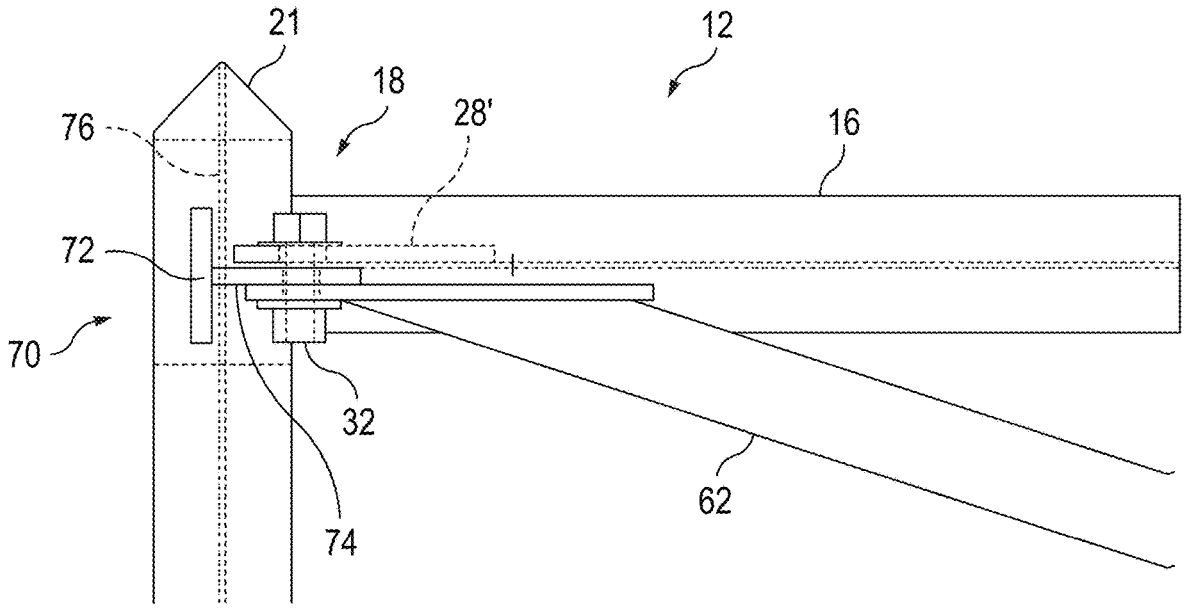
FIG. 6B illustrates another example of a pivotal connection of adjacent beam sections at a post.

FIGS. 5G and 5H illustrate an exemplary connector 70 configured for pivotally connecting a beam section to a post such as illustrated in FIG. 6B. In this embodiment, connector 70 is generally T-shaped having a first planar member 72 and a second planar member 74 extending in different planes perpendicular to one another. A hole 30 is formed through second planar member 74. With reference to FIG. 6B, in use the first planar member 72 extends in a vertical plane for connection with post 21, e.g., a web of the post, and the second planar member 74 extends in a horizontal plane away from post 21 with hole 30 oriented vertically for accepting a pin.

Figure 22:
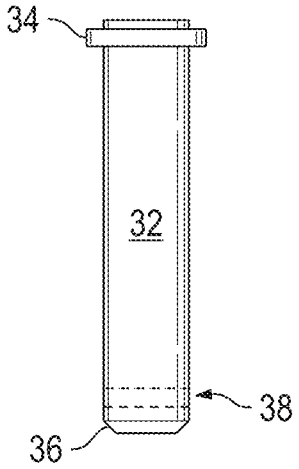
FIG. 22 illustrates an example of a pivot pin according to aspects of the disclosure.

FIG. 6A illustrates an example of adjacent beam sections 16 pivotally connected to each other at a line post 21. With additional reference to FIGS. 5E and 5F, connector 70 is connected to line post 21 with vertical holes 30 in connector 70 positioned on opposite sides of line post 21. For example, connector 70 is position in a web 76 of line post 21 with one hole 30 positioned on the left side of post 21 and the other hole 30 positioned on the right side of post 21. Left beam section 16 is positioned with hole 30 of beam plate 28 coaxial with one of the vertical holes 30 in connector 70 and right beam section 16 is positioned with hole 30 of beam plate 28 coaxial with the other one of the vertical holes 30 in connector 70. A pin 32 is positioned in coaxial holes 30 to create a pivoting connection at a joint 18, whereby adjacent beam sections 16 can pivot relative to one another and relative to line post 21 when beam 12 is impacted by a motor vehicle. In the illustrated example, pin 32 is in the form of a bolt with a securing nut. Another example of a pin 32 is illustrated in FIG. 22. Beam sections 16 each have a single beam plate 28 in FIG. 6A, however, beam sections 16 may have a two vertically spaced apart beam plates 28 as illustrated in FIGS. 5A and 5B.

FIG. 6B illustrates an example of a beam section 16 pivotally connected to a post 21 at a joint 18. With reference to FIGS. 5G and 5H, a connector 70 is attached to line post 21. For example, vertical member 72 of connector 70 is located on a first side of a center web 76 of post 21 with horizontal member 74 extending through center web 76 to a second side of post 21. Beam plate 28 of beam section 16 is positioned with connector 70 whereby a pin 32 pivotally attaches beam section 16 to post 21 at joint 18. In this example, a truss beam 62 is also attached at joint 18.

Figure 6C:
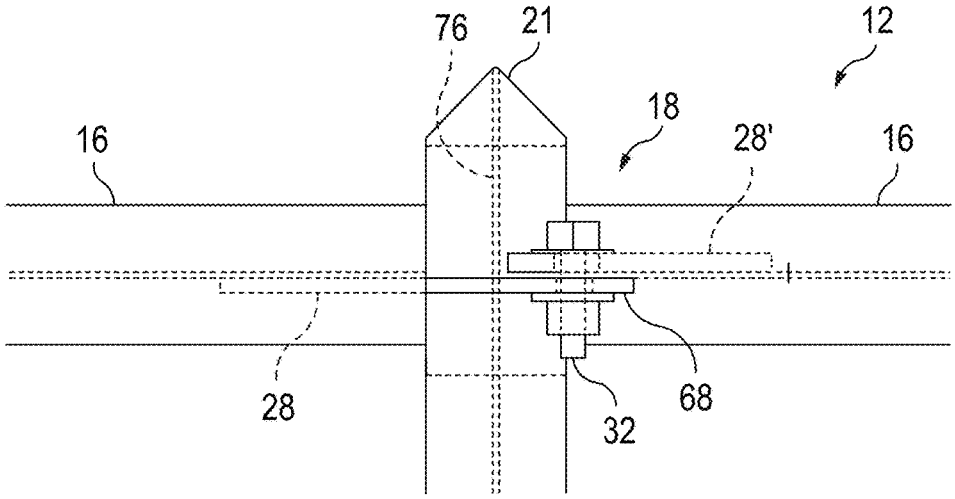
FIG. 6C illustrates another example of a pivotal connection of adjacent beam sections at a post.

FIG. 6C illustrates another example of a pivotal connection of adjacent beam sections 16 via a joint 18 at a line post 21. Beam plate 28, e.g., male beam plate 28, extends from beam section 16 on the left of post 21 through web 76 to the right side of post 21. Beam plate 28' of the right beam section 16 is positioned above beam plate 28 with their vertical holes coaxially aligned. A pin 32 is positioned in beam plates 28, 28' pivotally connecting adjacent beam sections 16 at joint 18.

With reference, in particular to FIGS. 7-18, some embodiments of PVB 10 include braces 20 attached to beam 12. Braces 20 are located on the protected side and have a first end attached to beam 12 and a second end secured in a foundation 24, whereby the foundation and the brace form two adjacent sides of a vertex having an acute angle. The brace and the foundation form a sled to absorb or counter the impact force of the vehicle 11. Braces 20 may be connected to beam 12 at joints 18 (see, e.g., FIGS. 7 and 10) and/or connected to beam 12 at intermediate positions between the joints 18 (see, e.g., FIG. 16). Although braces 20 are illustrated in FIGS. 1 to 4 as being located with posts 22, the braces may be located separately from a post.

Foundation 24 is concrete and may be a shallow or a deep foundation. A concrete foundation having a depth, for example, of about twenty inches or less, may be considered a shallow foundation. Concrete foundation 24 may be about eighteen inches or less. Concrete foundation 24 may be about twelve inches or less. Concrete foundation 24 may be about six inches or less. Concrete foundation 24 may extend the length of beam 12 as shown for example in FIGS. 3 and 4 or concrete foundation 24 may be provided only at selected locations, such as at line posts 21 and/or braces 20 as illustrated in FIGS. 1 and 2.

Figure 7:
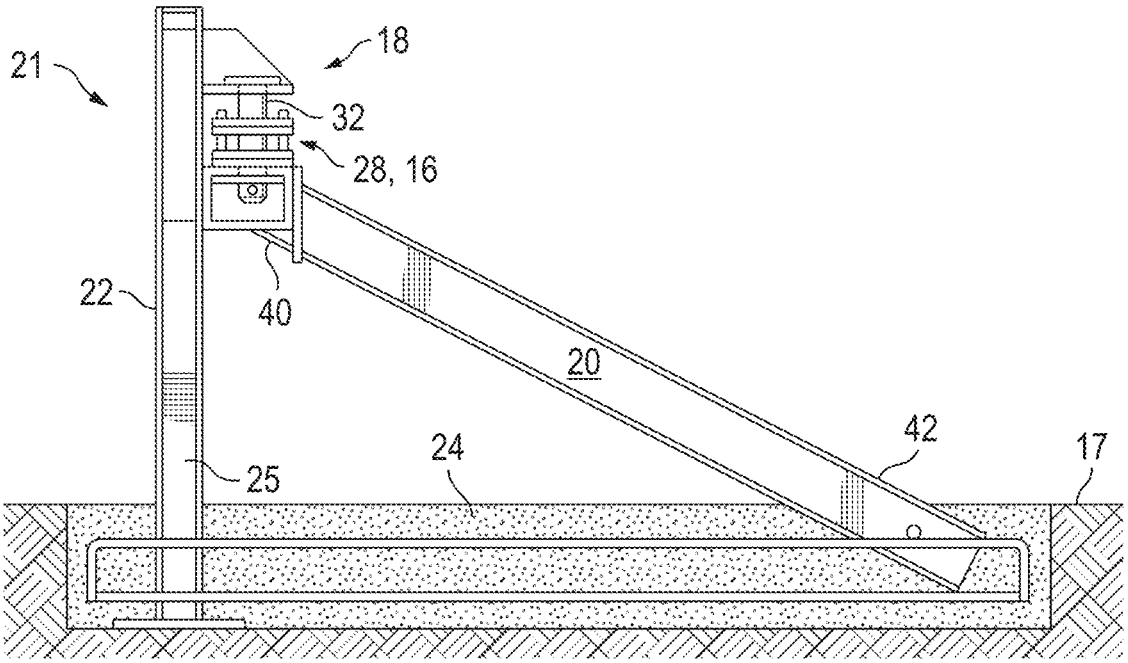
FIG. 7 illustrates an example of a brace that may be connected to a beam at a joint between beam sections.
Figure 8A:
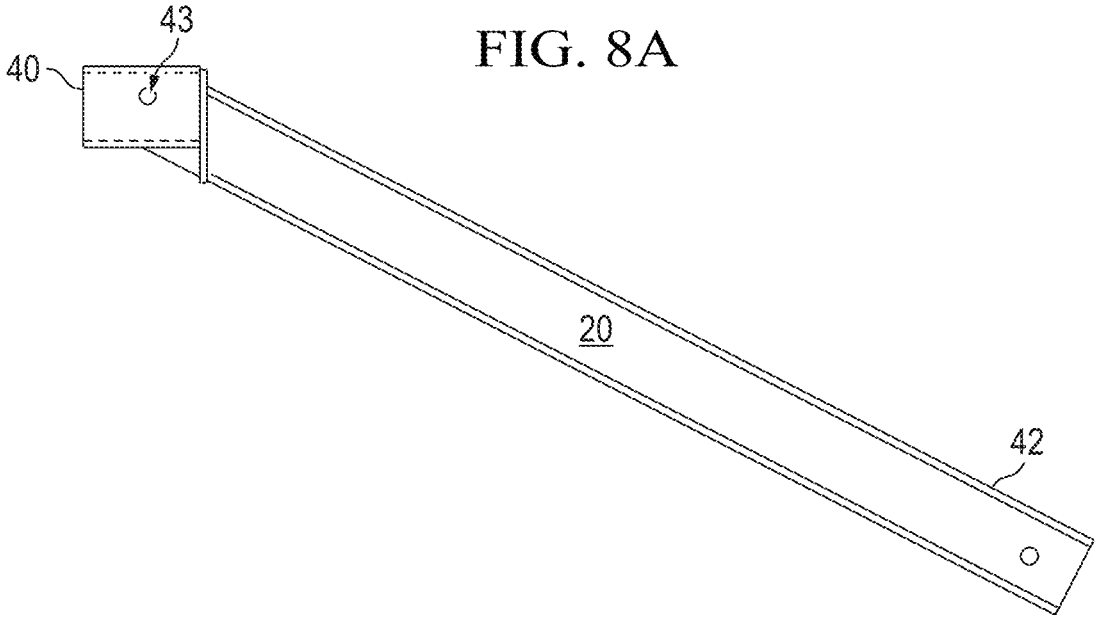
FIGS. 8A and 8B illustrate an example of the brace of FIG. 7.
Figure 8B:
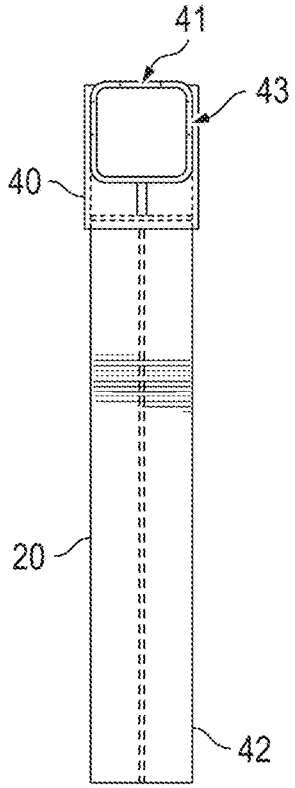

FIG. 7 illustrates an example of a brace 20 that may be connected to beam 12 at a joint 18. With reference also to FIGS. 8A and 8B, brace 20 is, for example, a metal member extending from a first end 40 to a second end 42. First end 40 is connected to adjacent beam sections 16 via pivot pin 32 and second end 42 is disposed in foundation 24. A non-limiting example of a pivot pin 32 is illustrated in FIG. 22. Brace 20 may be constructed for example of an I-beam type member, e.g., W-beam. In this example, foundation 24 is a shallow concrete foundation extending for example about 18 inches or less below the ground level. In some embodiments, foundation 24 is a shallow concrete foundation extending for example about 12 inches or less below the ground level.

In this example, first end 40 is a rectangular shaped member extending horizontally relative to ground level and having a vertical hole 41 through which a tail end of pivot pin 32 is disposed, and a cross-hole 43 that may be aligned with a cross-hole 38 in pivot pin 32 (see, FIG. 22). Beam plates 28 of adjacent beam sections 16 overlap with holes 30 of beam plates 28 (FIG. 5B) coaxially aligned and positioned atop first end 40 of brace 20. Pivot pin 32 is disposed in coaxial holes 30 of beam plates 28 and vertical hole 41 providing a pivoting connection between adjacent beam sections 16 and brace 20. In this configuration, brace 20 in combination with the foundation 24 forms a sled to absorb the force of the impact of the motor vehicle from the attack side. Foundation 24 and brace 20 form two adjacent sides of a vertex having an acute angle 7.

In FIG. 7, a vertical post 22 in a line post 21 configuration is connected with brace 20 and beam 12 at joint 18. Vertical post 22 is a metal member having a bottom end 25 located in foundation 24. In the example of FIG. 7, posts 22 are positioned on the attack side relative to beam 12.

Figure 9A:
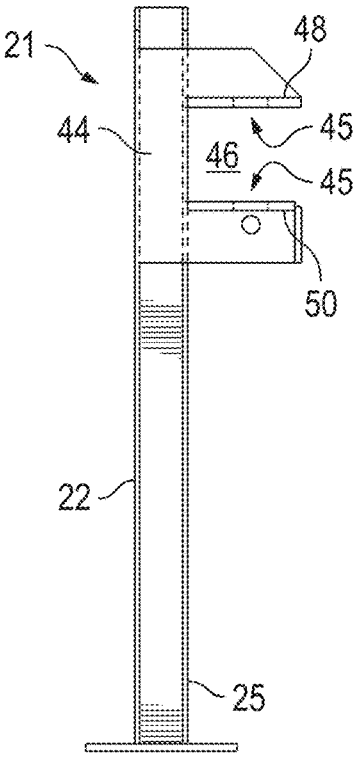
FIGS. 9A and 9B illustrate an example of a line post that may be connected to the brace in FIG. 7.
Figure 9B:
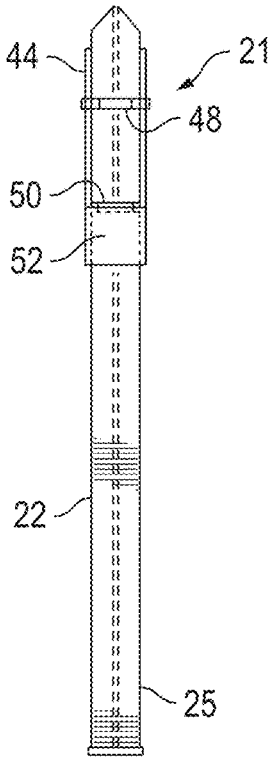

FIGS. 9A and 9B illustrate an example of a post 22 used as a line post 21 in FIG. 7. The illustrated line post 21 includes a C-shaped frame 44 forming a cavity 46 between a top shelf 48 and a bottom shelf 50 and coaxial holes 45 through shelves 48, 50. In this example, bottom shelf 50 is formed by a rectangular member having a pocket 52 sized to dispose first end 40 of brace 20. With reference also to FIGS. 7, 8A and 8B, beam plates 28 of adjacent beam sections 16 are positioned in cavity 46 and first box end 40 of brace 20 is positioned inside of pocket 52. Pivot pin 32 is positioned in coaxial holes 45 of top and bottom shelves 48, 50, vertical hole 41, and holes 30 in beam plates 28. Pivot pin 32 can be secured by positioning a locking member 56 (see, e.g., FIGS. 10 and 14) is coaxially aligned cross-holes 47, 43, 38, in bottom shelf 50, first box end 40, and tail end 36 of pivot pin 32. A tamper resistant connection is formed with the head of the pivot pin flush mounted and the tail of the pivot pin located in the pocket and the first end of the brace.

FIGS. 10-13 illustrate another example of a brace 20 that may be connected with beam 12 at a joint 18. Brace 20 is, for example, a metal member extending from a first end 40 to a bottom end 42 to be disposed in the foundation. Brace 20 may take various forms including being an I-beam, such as a W-beam. In this example, first end 40 includes top shelf or plate 48 and bottom spaced apart plate 50, which have coaxial holes 45 for disposing a pivot pin 32. In use, beam plates 28 of adjacent beam sections 16 are interleaved and disposed between plates 48, 50 of brace 20, and pivot pin 32 is disposed in coaxial holes 45 in plates 48, 50 and holes 30 in beam plates 28 thereby connecting brace 20 to the adjacent beams 16.

Brace 20 may be connected to a line post 21. In the configuration of FIGS. 10-13, beam 12 and posts 22 are aligned substantially in the same vertical plane, as illustrated for example in FIGS. 3 and 4. Post 22 has a bottom end 25 to be disposed for example in the foundation and an upper end 27. Post 22 may take various shapes and is a rectangular member in this example. Beam plates 28 of adjacent beam sections 16 may be connected to or proximate to top end 27. For example, in the illustrated example, bottom plate 50 of the pair of plates forming the first end of brace 20 may be positioned on top of the top end of post 22 or disposed in a slot 33 just below a top end of post 22. A pivot pin 32 may be positioned in the beam plates, the first end of the brace, and connected to post 22. A locking mechanism 56 (FIG. 10) may be disposed through a cross-hole 29 (FIG. 11) in post 22 to secure pivot pin 32 vertically relative to post 22.

Figure 14:
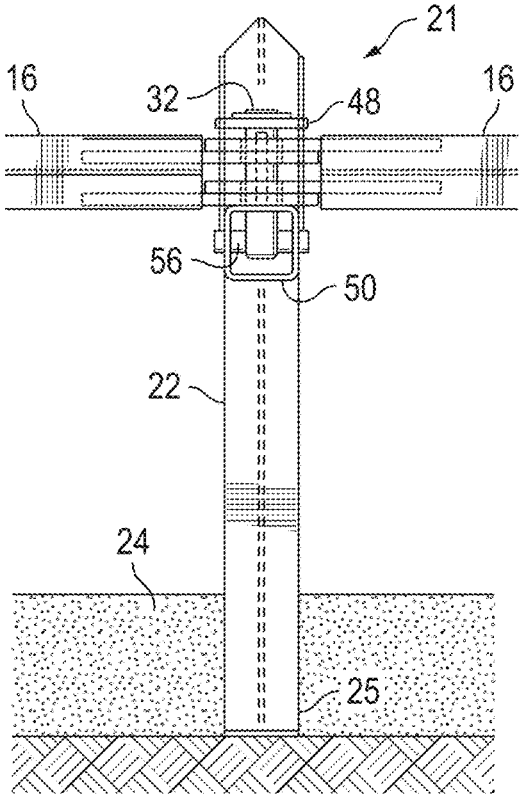
FIG. 14 is an elevation view from the attack side of another example of a brace that may be connected to a beam at a joint between beam sections.
Figure 15:
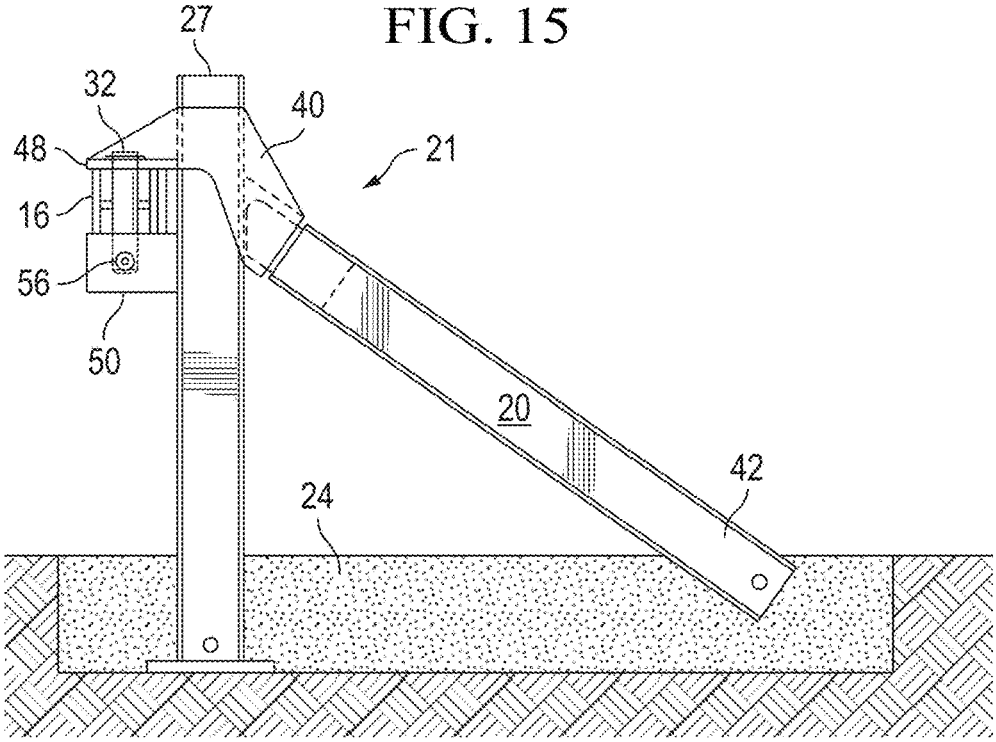
FIG. 15 is a side elevation view of the brace connection of FIG. 14.

FIGS. 14 and 15 illustrate another non-limiting example of a brace 20 that may be connected to beam 12 at a joint 18 and at a vertical post 22 in a line post 21 configuration. Line post 21 extends from a bottom end 25 disposed in a foundation 24 to a top end 27. Brace 20 has a first end 40 configured to be disposed over top end 27 of line post 21 and to connect to beam 12 with line posts 21 located on the protected side of beam 12. A bottom shelf 50 is positioned on the attack side of the post 22. Beam plates 28 of adjacent beam sections 16 are interleaved and positioned atop bottom shelf 50 and between a top shelf 48 of first end 40 of brace 20 and bottom shelf 50. A pivot pin 32 is disposed through the top and bottom shelves and the interleaved beam plates and a locking member 56 is disposed through cross-hole 38 (FIG. 22) in pivot pin 32. Similar to FIG. 7, bottom shelf 50 may form a pocket in which the tail end of the pivot pin is located to provide resistance to tampering with the connection.

Figure 16:
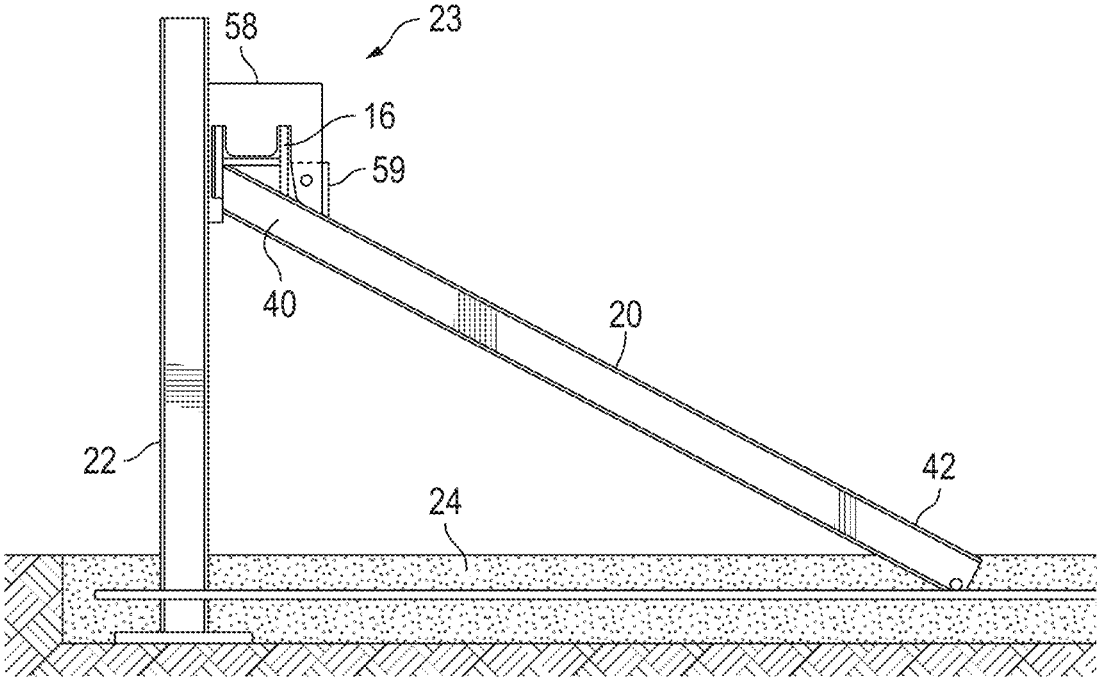
FIG. 16 is an elevation view of a brace that may be connected to a beam at an intermediate position.
Figure 17:
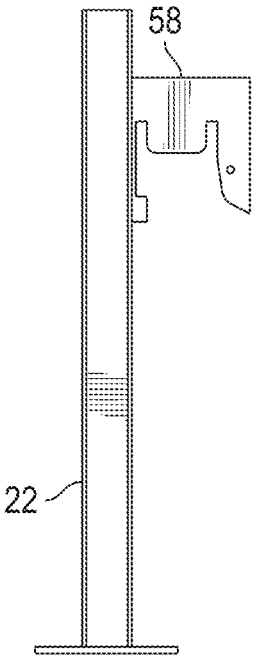
FIG. 17 illustrates an example of an intermediate post that may be connected to the beam and/or the beam and a brace.
Figure 18:
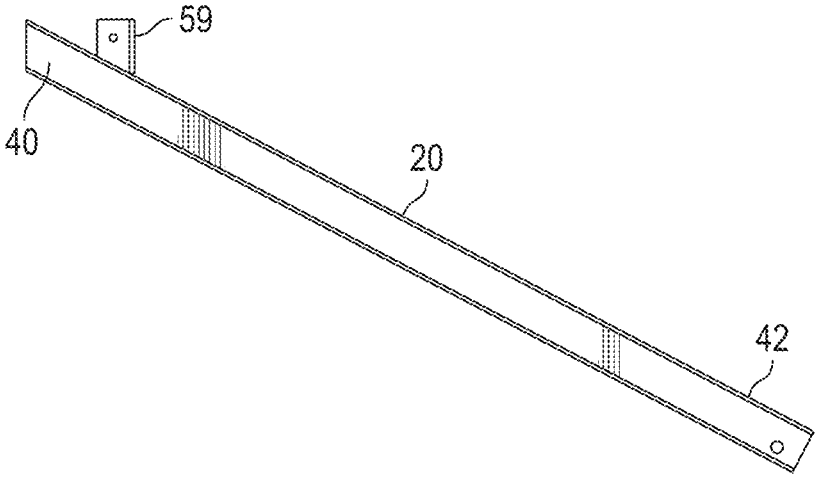
FIG. 18 illustrates the brace of FIG. 16.

FIG. 16 illustrates an example of a brace 20 that may be connected to beam 12 at an intermediate position. Brace 20 may be attached to a post 22 in an intermediate post 23 configuration as illustrated in FIG. 16. With additional reference to FIGS. 17 and 18, intermediate post 23 has a bracket 58 located for example on the protected side to connect to a beam section 16. Bracket 58 includes a W-pattern to be positioned atop a W-shaped (e.g., wide flange beam) I-beam section 16 as illustrated in FIG. 16. Brace 20 has a bracket 59 to connect to post bracket 58 and that is positioned a distance away from first end 40 so that first end 40 can be positioned under beam section 16.

Figure 10:
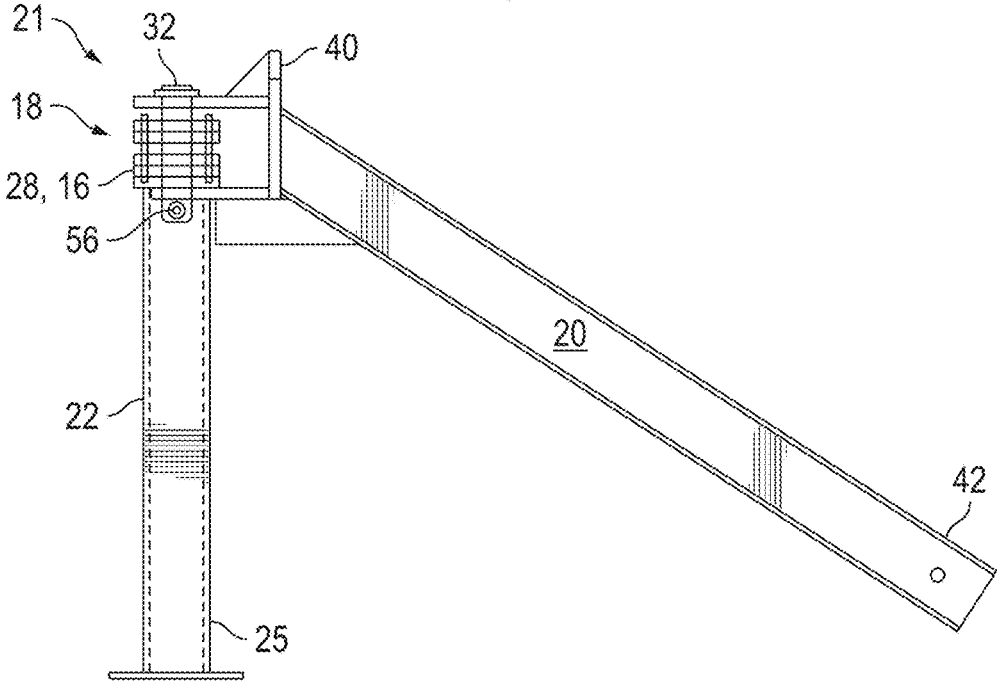
FIG. 10 is an elevation view of an example of a brace that may be connected to a beam at a joint between beam sections.
Figure 11:
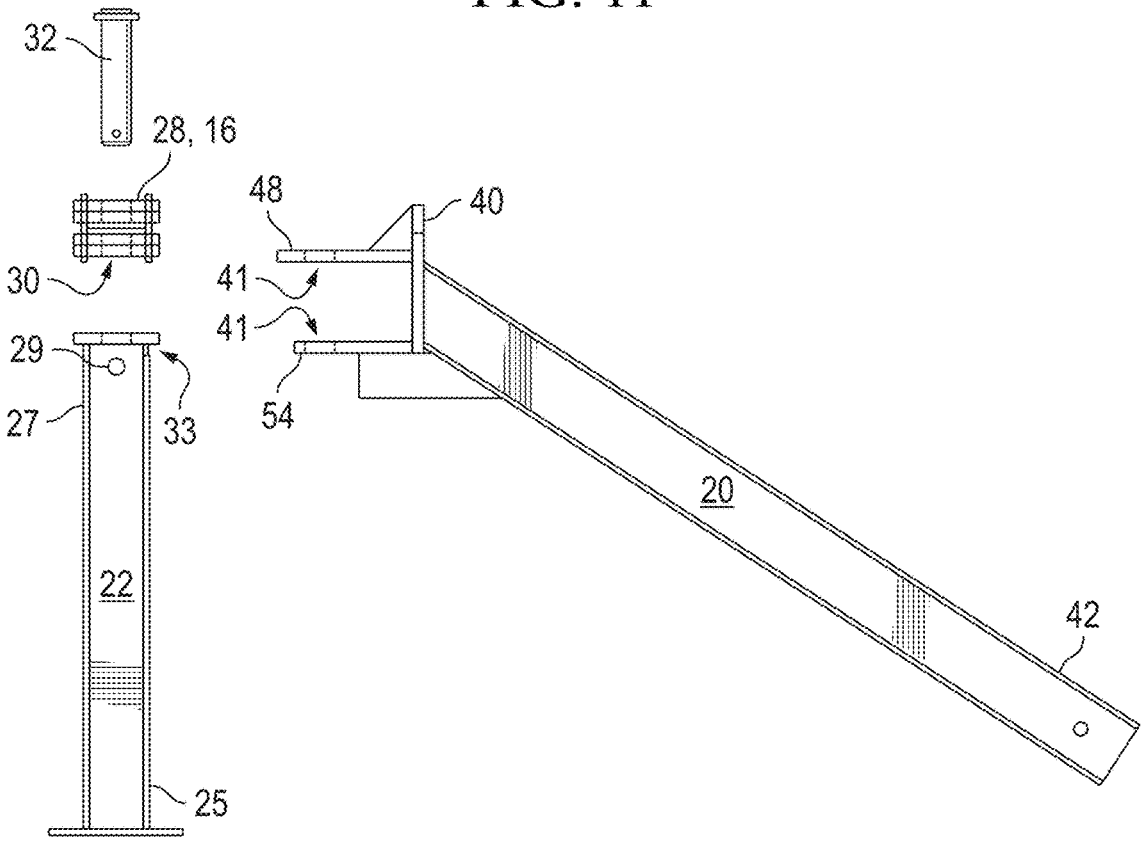
FIG. 11 is an exploded elevation view of the brace connection of FIG. 10.
Figure 12:
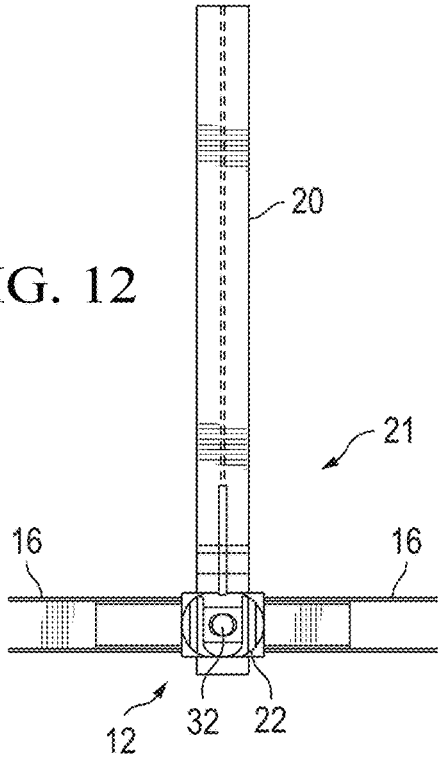
FIG. 12 is a plan view of the brace connection of FIG. 10.
Figure 13:
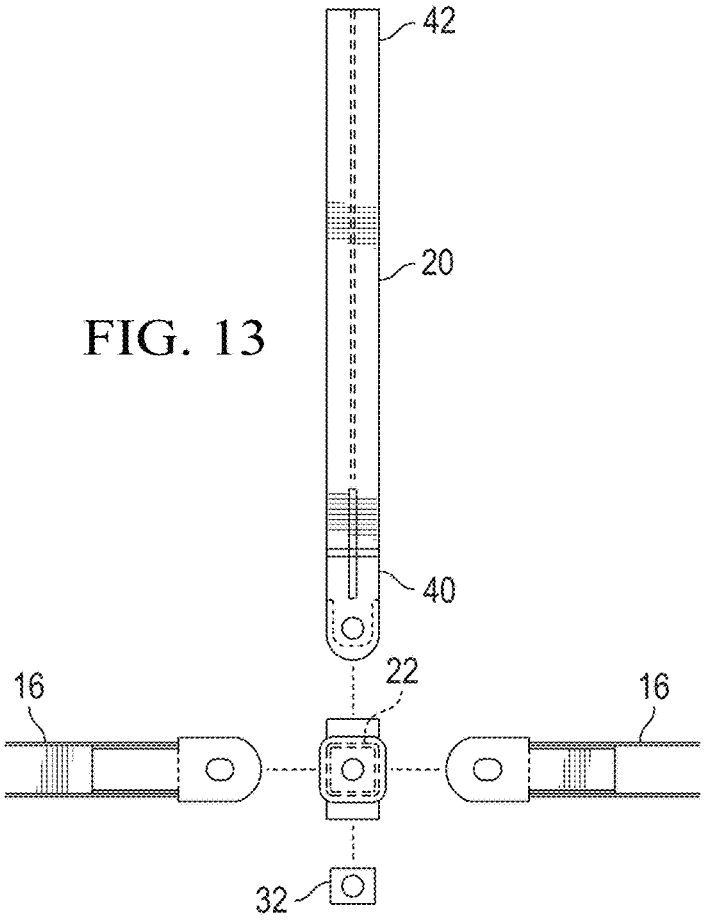
FIG. 13 is an exploded plan view of the brace connection of FIG. 10.
Figure 19:
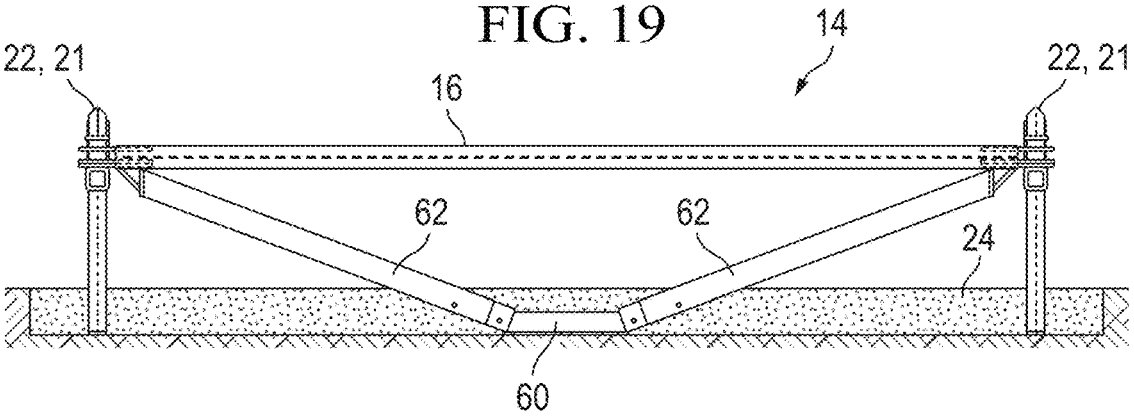
FIGS. 19 and 20 illustrate examples of truss sections according to aspects of the disclosure.
Figure 20:
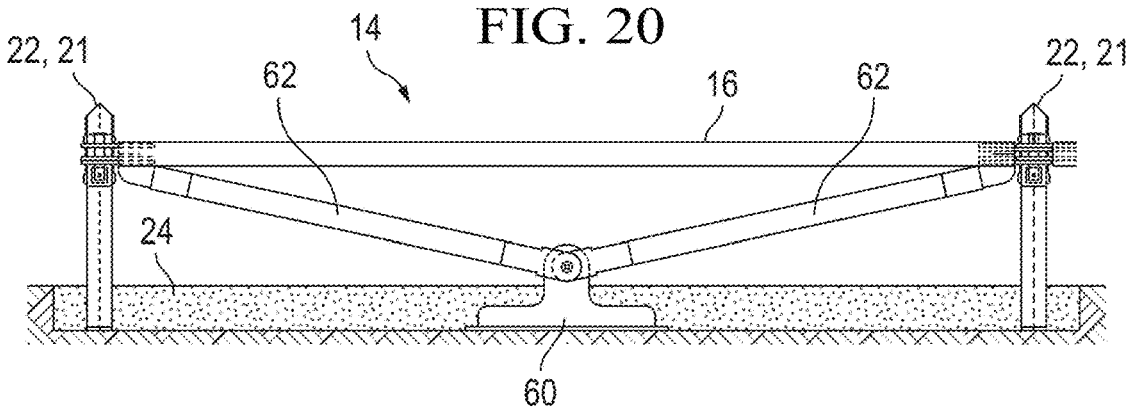

FIGS. 19 and 20 illustrate examples of truss sections 14 having a push-pull design according to aspects of the disclosure, described with additional reference to FIGS. 1-4. Truss section 14 has spaced apart posts 22, which may be in a line post 21 configuration. In a non-limiting example, truss section 14 may include braces 20 at one or more of posts 21 for example as illustrated in FIG. 7 or FIG. 10. A horizontal beam section 16 is connected between posts 22 of truss section 14. A truss anchor 60 is secured in the foundation proximate the center point between posts 22 in truss section 14. One truss beam 62 is connected to one post 22 and truss anchor 60 and a second truss beam 62 is connected to the other post 22 and truss anchor 60.

Figure 21:
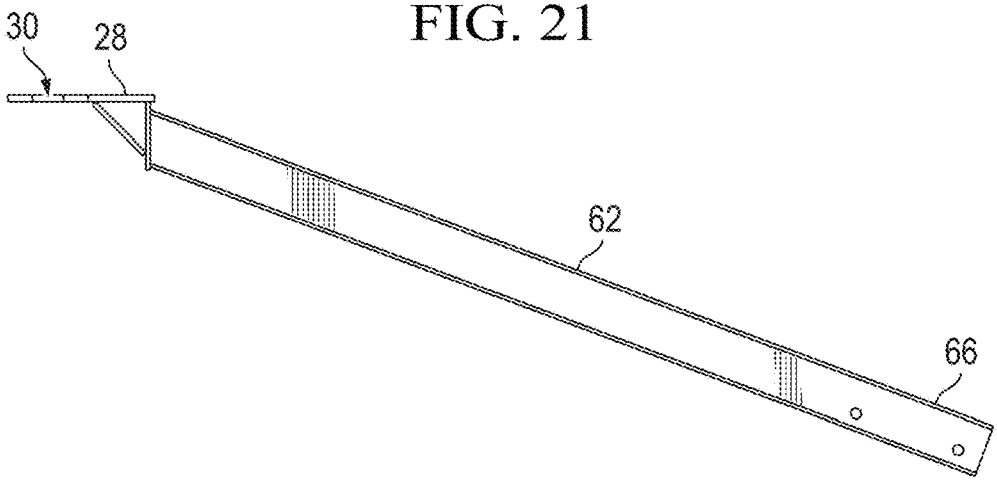
FIG. 21 illustrates an example of a truss beam according to aspects of the disclosure.

FIG. 21 illustrates an example of a truss beam 62 according to an embodiment. Truss beam 62 has a first end 64 having a beam plate 28 with a hole 30 and a second end 66 configured for connecting to truss anchor 60. In the example illustrated in FIG. 19, the second ends of the truss beam are disposed in the foundation 24.

FIG. 22 illustrates an exemplary pivot pin 32 having a head 34 opposite a tail end 36. In some embodiments, tail end 36 has a cross-hole 38, for example, to dispose a locking member, see e.g., FIG. 14.

A passive vehicle barrier according to at least one embodiment includes a plurality of interconnected beam sections, forming a beam positioned above ground level and secured to the ground via a plurality of spaced apart posts. Adjacent beam sections are pivotally connected to one another. In some embodiments, the passive vehicle barrier is an anti-ram barrier is configured to meet or meets ASTM F2656 standards. The posts may be positioned at pivotal connections between adjacent beam sections and/or positioned between pivotal connections.

In some embodiments, braces can be attached to the beam and the ground to form two sides of a triangle and provide a stopping force to a motor vehicle impacting the beam. One or more of the braces may be connected with a vertical post that forms a third side of the triangle.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure and that they may make various changes, substitutions, and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A vehicle barrier, comprising:

a longitudinally extending beam positioned vertically above a ground level and separating a protected side from an attack side, the beam comprising beam sections;

each of the beam sections comprising a web oriented generally parallel to the ground level;

a line post positioned on the attack side and comprising a bottom end positioned in a concrete foundation and a frame;

a line brace having a first brace end located with the frame and a second end secured in the concrete foundation such that the line brace and the concrete foundation form adjacent sides of a vertex on the protected side; and adjacent beam sections pivotally connected to each other at the frame and the first brace end.

2. The vehicle barrier of claim 1, wherein the adjacent beam sections are pivotally connected by a pin in connection with the frame and the adjacent beam sections.

3. The vehicle barrier of claim 1, wherein the adjacent beam sections are pivotally connected by a pin in connection with the frame, the line brace, and the webs of the adjacent beam sections.

4. The vehicle barrier of claim 1, wherein the adjacent beam sections comprise overlapping beam plates; and the adjacent beam sections are pivotally connected by a pin in connection with the frame and the overlapping beam plates.

5. The vehicle barrier of claim 1, wherein:

the frame comprises a rectangular member extending from the post toward the protected side, the rectangular member providing a pocket;

the first brace end is disposed inside of the pocket; and the adjacent beam sections are pivotally connected by a pin in connection with the rectangular member and the adjacent beam sections.

6. The vehicle barrier of claim 5, wherein the pin terminates inside of the pocket.

7. The vehicle barrier of claim 5, wherein the first brace end is box-shaped.

8. The vehicle barrier of claim 7, wherein the pin terminates inside of the first brace end.

9. The vehicle barrier of claim 1, wherein the frame comprises a rectangular member extending from the post toward the protected side, the rectangular member forming a pocket;

portions of the adjacent beam sections overlap above the rectangular member;

the first brace end is disposed inside of the pocket; and the adjacent beam sections are pivotally connected by a pin in connection with the rectangular member and the adjacent beam sections.

10. The vehicle barrier of claim 9, wherein the portions are plates.

11. The vehicle barrier of claim 9, wherein the pin terminates inside of the pocket.

12. The vehicle barrier of claim 9, wherein the first brace end is box-shaped.

13. The vehicle barrier of claim 12, wherein the pin terminates inside of the first brace end.

14. The vehicle barrier of claim 1, wherein:

the frame forms a cavity between a top shelf and a bottom shelf;

portions of the adjacent beam sections are positioned in the cavity; and the adjacent beam sections are pivotally connected by a pin in connection with the top shelf, the portions, and the bottom shelf.

15. The vehicle barrier of claim 14, wherein the portions are plates.

16. The vehicle barrier of claim 14, wherein the pin is in connection with the first brace end.

17. The vehicle barrier of claim 16, wherein the first brace end is box-shaped and the pin terminates inside of the first brace end.

18. The vehicle barrier of claim 1, wherein:

the frame comprises a cavity between a top shelf and a bottom shelf and a rectangular member forming a pocket below the bottom shelf;

portions of the adjacent beam sections are positioned in the cavity;

the first brace end is disposed inside of the pocket; and the adjacent beam sections are pivotally connected by a pin in connection with the top shelf, the portions, and the bottom shelf.

19. The vehicle barrier of claim 18, wherein the pin terminates inside of the pocket.

20. The vehicle barrier of claim 18, wherein the first brace end is box-shaped; and the pin terminates inside of the first brace end inside of the pocket.

* * * * *